United States Patent [19]

Behrens

[11] 4,165,660

[45] Aug. 28, 1979

[54] ALIGNMENT PIN INSTALLATION TOOL

[75] Inventor: Jack D. Behrens, Moorpark, Calif.

[73] Assignee: Bunker Ramo Corporation, Oak Brook, Ill.

[21] Appl. No.: 834,569

[22] Filed: Sep. 19, 1977

[51] Int. Cl.[2] ..... B25B 13/48

[52] U.S. Cl. ..... 81/55

[58] Field of Search ..... 81/55, 56, 3 F

[56] References Cited

U.S. PATENT DOCUMENTS

| | | | |
|---|---|---|---|
| 1,626,730 | 5/1927 | Haynes | 81/121 R |
| 3,394,623 | 7/1968 | Kinakin | 81/55 |
| 3,779,105 | 12/1973 | Triplett et al. | 81/121 R |
| 3,889,558 | 6/1975 | Duncan | 81/55 |

*Primary Examiner*—James L. Jones, Jr.

*Attorney, Agent, or Firm*—F. M. Arbuckle; A. Freilich

[57] ABSTRACT

A tool for installing an alignment pin assembly that includes a bolt with a hexagonal socket at one end, a locking nut that must be tightened on the bolt while the bolt is held against turning, and an adjustment nut which may have to be turned slightly relative to the bolt and locking nut. The tool includes a first nut engageable socket for engaging the locking nut, a key extending along the axis of the socket and slideable thereon to engage the hexagonal socket of the bolt, a second nut-engageable socket rotatably mounted about the first one for engaging the adjustment nut, and separate handles for turning the first socket and preventing turning of the key.

3 Claims, 4 Drawing Figures

ALIGNMENT PIN INSTALLATION TOOL

BACKGROUND OF THE INVENTION

This invention relates to a tool constructed to install an alignment pin assembly.

A chassis can be mounted on a cabinet and closely adjusted in position by the use of an alignment pin assembly. Such an assembly may include a bolt extending through the cabinet and having a threaded rearward end extending along a first axis and a forward chassis-engaging end lying on a second axis offset from the first. Slight turning of the bolt about the first axis can cause its forward end to move slightly up or down to hold the chassis at the proper height. Th pin assembly can also include an adjustment nut closely surrounding the bolt and having a camming portion offset from the first axis, so that slight turning of the adjustment nut can shift the chassis to one side. The assembly is securely held in position after all adjustments have been made, by a locking nut that screws onto the rearward portion of the bolt. The bolt can be held against turning when the nut is tightened, by inserting an hexagonal key into an hexagonal socket at the rearward end of the bolt. Also, it may be necessary to apply a wrench to the adjustment nut, either to turn it slightly to align the chassis or to prevent turning of the adjustment nut as the locking nut is being screwed tightly against it. It can be appreciated that the two or three different tools that have to be utilized can make installation difficult, especially where the pin assembly lies in a hidden region so that adjustments must be made from a blind position.

SUMMARY OF THE INVENTION

In accordance with one embodiment of the present invention, an easily-constructed tool is provided which greatly facilitates the adjustment and final installation of an alignment pin assembly. The tool includes a nut-engageable socket which can engage the locking nut on the bolt of a pin assembly, a key which can fit into the hexagonal socket formed at the rear of the bolt, with the key extending along the axis of the socket and rotatable relative to the socket, and socket and key handles for respectively turning and preventing turning of the socket and key. An outer socket larger than the inner socket that engages the locking nut can be provided which is rotatably mounted on the inner socket, and with the outer socket extending slightly forward of the inner socket to engage the adjustment nut.

The novel features of the invention are set forth with particularity in the appended claims. The invention will best be understood from the following description when read in conjunction with the accompanying drawing.

DESCRIPTION OF THE PREFERRED EMBODIMENTS

Figure 1:
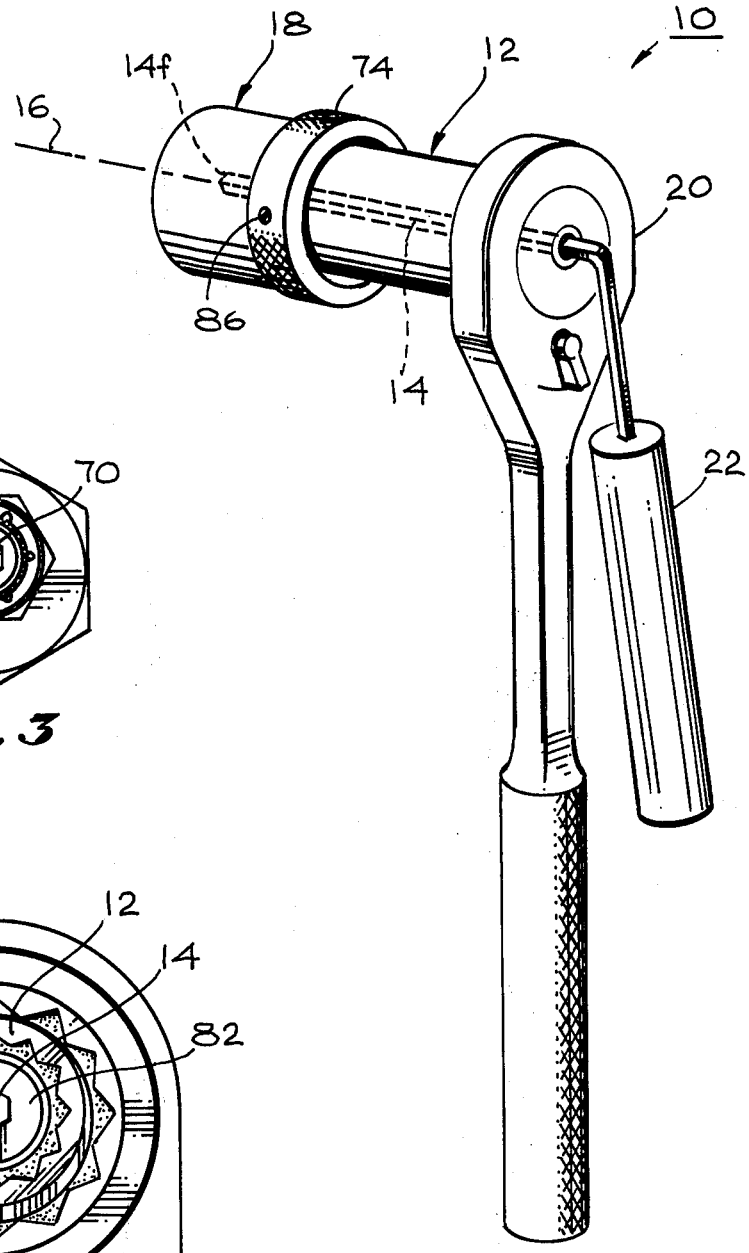
FIG. 1 is a rear perspective view of a tool constructed in accordance with the present invention.
Figure 3:
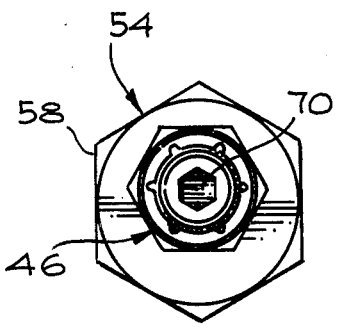
FIG. 3 is an end view of the alignment pin assembly of FIG. 2.
Figure 4:
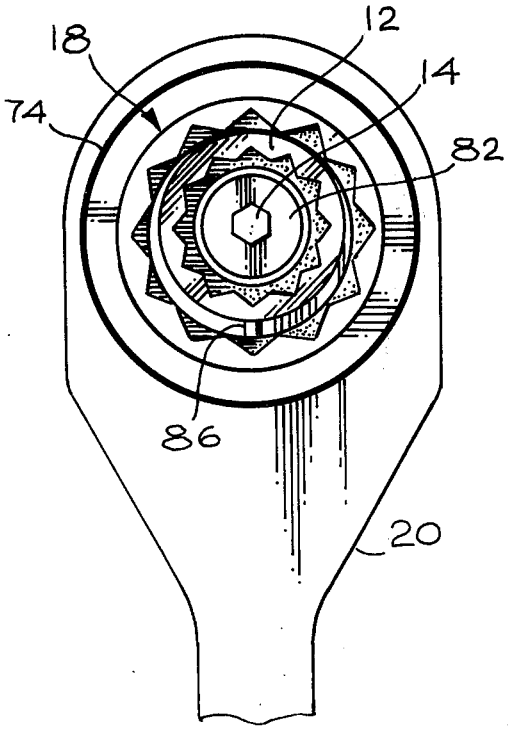
FIG. 4 is a front end view of the tool of FIG. 2.

FIG. 1 illustrates a tool 10 constructed in accordance with the invention, which includes an inner socket 12, a hexagonal key 14 which extends along the axis 16 of the inner socket, and an outer socket 18 which is rotatably mounted on the inner socket. The rearward end of the inner socket 12 is mounted on a ratcheting handle 20, while the inner end of the key 14 is mounted on a key handle 22.

Figure 2:
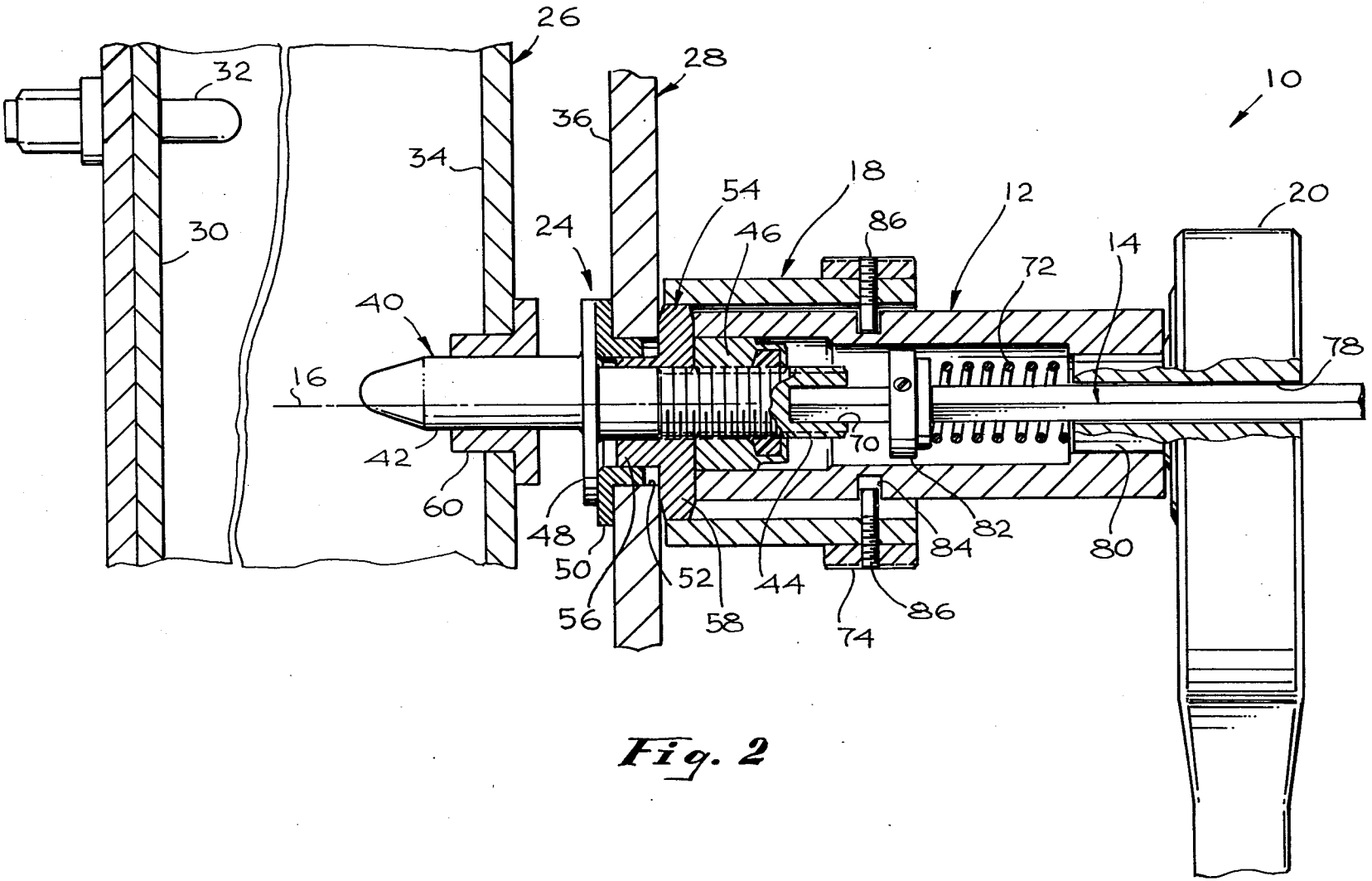
FIG. 2 is a sectional side view of the tool of FIG. 2, shown during the installation of an alignment pin assembly on a chassis and cabinet.

FIG. 2 shows the manner in which the tool 10 is utilized to install an alignment pin assembly 24 to hold a chassis 26 to a cabinet 28. The chassis 26 is shown with a forward wall 30 held by a shear pin 32 to a forward wall of the cabinet, and with another wall 34 which must be accurately aligned and mounted on a cabinet wall 36. The pin assembly 24 permits the chassis wall 34 to be slightly raised or lowered slightly and to be slightly shifted horizontally so as to achieve accurate alignment of connectors on the chassis and cabinet. To this end, the pin assembly includes a bolt 40 with a forward end 42 designed to engage the chassis, a threaded rearward end 44 designed to receive a locking nut 46 that locks the pin in place, and a flange 48 at the middle. The assembly also includes a washer 50 that lies closely within a hole 52 formed in the cabinet wall, and an adjustment nut 54 with an offset portion 56 that fits closely between the inside of the washer 50 and the outside of the bolt rearward bolt portion 44. The outside of the offset nut portion 56 is cylindrical about an axis which is offset from the axis of the inner surface thereof, so that as the nut portion 56 turns it shifts the position of the bolt from side to side or up or down. A nut-like portion 58 of the adjustment nut can be turned to turn the offset portion 56 thereof.

The alignment pin assembly is first installed with the locking nut 46 a few turns rearward of a fully tightened position. The bolt 40 and adjustment nut 54 must then be turned until the technician senses that the forward bolt portion 42 lies loosely within a hole 60 in the chassis wall. It may be assumed, for purposes of explanation, that turning of the bolt 40 adjusts the vertical position of the chassis wall, while turning of the adjustment nut 54 adjusts the horizontal position of the bolt, so that the forward end of the bolt has been adjusted both in vertical and horizontal directions to align it with the chassis. Actually, the bolt and adjustment nut each affect both vertical and horizontal position. Once such alignment has been achieved, the locking nut 46 must be turned to securely fix the pin assembly in place. Of course, this requires that neither the bolt 40 nor the alignment nut 64 turn while the locking nut 46 is being turned.

The tool 10 is utilized in the manner illustrated in FIG. 2, with the key 14 installed in an hexagonal socket 70 that is formed at the rearward end of the bolt 40. Also, the inner socket 12 is pressed forwardly against the bias of a spring 72 until it surrounds the locking nut 46. The socket handle 20 is then turned with one hand, while the key handle 22 is held against turning with the other hand, until the locking nut 46 has been fully tightened. It is also possible to utilize a finger of the same hand that is holding the key handle 22, to engage the outer socket 18, to determine whether it and the alignment nut 54 are being turned. Normally, tightening of the locking nut will not result in turning of the alignment nut, but the technician can be assured of this fact by pressing a finger against a knurled flange 74 on the outer socket.

The key 14 is slidable along the axis 16 of the inner socket 12, and is biased forwardly by the spring 72. In the most forward position of the key, its forward end 14*f* lies about even with the forward end of the inner socket 12. Accordingly, when the locking nut 46 is not tightened, the key can engage the socket of the bolt 40 to turn the bolt for alignment purposes. Also, the fact that the outer socket 18 extends slightly forward of the inner socket, means that it can engage the adjustment nut 54 to turn it slightly for proper alignment. The nut portion 58 of the alignment nut is relatively thin so that it cannot be firmly grasped by the fingers of a hand, and so the provision of an outer socket with a knurled flange 74 to turn the adjustment nut makes turning much easier.

The tool can be constructed utilizing an ordinary socket wrench handle for the handle 20, except that a hold 78 is drilled along the axis of the square socket-engaging member 80 of the wrench to permit the key 14 to slideably and rotatably lie therein. The key 14 can be constructed from an ordinary hexagonal key assembly, by attaching a collar 82 thereto to hold the spring 72 in place. The inner socket 12 can be formed from an ordinary socket of the type designed to fit on a ratchet wrench handle by forming a groove 84 therein which can loosely receive the ends of set screws 86. The outer socket 18 can be formed by cutting it off of a complete ordinary socket designed to fit on the ratchet wrench 20, and by adding a ring that serves as the flange 74, and which is held to the rest of the outer socket by the set screws 86. It may be noted that the outer socket 18 is preferably free to move slightly radially with respect to the inner socket, so that where the outside of the adjustment nut portion 58 is offset from the hole therein which engages the rear of the bolt, the outer socket 18 can shift in radial position to remain engaged with the adjustment nut.

Thus, the invention provides a tool for the installation of an alignment pin assembly, which facilitates the adjustment of one or two different adjustable parts of the assembly and the tightening of a locking nut on the assembly to hold it securely in place, even where the assembly is located in a hard-to-reach region. This is accomplished by utilizing a key extending along the axis of a socket and rotatable and slideable therealong. The socket is attached to a socket handle for turning it, and the key is attached to a key handle that can be used to prevent turning of the bolt of the pin assembly. An outer socket can also be provided which is rotatably mounted on the inner socket and which has an end which projects slightly forward of the forward end of the inner socket, to engage an adjustment nut of the pin assembly.

Although particular embodiments of the invention have been described and illustrated herein, it is recognized that modifications and variations may readily occur to those skilled in the art, and consequently it is intended that the claims be interpreted to cover such modifications and equivalents.

What is claimed is:

1. A fastening system, comprising:

an alignment pin assembly that includes a bolt having a threaded rearward portion with a key-receiving recess at the rearward end and an offset forward bolt portion, an adjustment nut with a hole receiving the bolt and an outer surface offset from the hole, and a locking nut for turning on the rearward bolt portion to lock the bolt and adjustment nut in position;

a socket wrench which includes an inner socket lying on a predetermined axis, said socket having an open front end formed to closely engage the locking nut and an opposite rear end, said wrench also including a handle at said rearward end of said socket;

a key wrench rotatable in said socket wrench, said key wrench including a key having a forward end formed to closely fit said key-receiving recess in said bolt to turn or prevent turning of the bolt, and a handle at a rearward end of said key opposite said forward end; and an outer socket rotatably mounted on said inner socket to engage the adjustment nut, said outer socket being radially shiftable with respect to said inner socket to follow the offsetting of said adjustment nut, whereby to enable holding of the adjustment nut at any rotatable position while tightening the locking nut.

2. The system described in claim 1 wherein:

said handle of said socket wrench has a through hole extending along the axis of the inner socket; and said key extends through said hole in said socket handle, and said key handle lies behind said socket wrench handle; and including a collar disposed on a portion of said key that lies within said socket; and a coil spring mounted on said key and extending between said collar and said wrench handle.

3. The system described in claim 1 wherein:

said outer socket is radially shiftable with respect to said inner socket, by at least one-tenth the inside diameter of said inner socket.

* * * * *